US006510638B1

(12) United States Patent
Wang

(10) Patent No.: US 6,510,638 B1
(45) Date of Patent: Jan. 28, 2003

(54) PICTURE FRAME

(75) Inventor: Walter Wang, Taipai (TW)

(73) Assignee: Welco Photo Frame Inc, Taipai (TW)

( * ) Notice: Subject to any disclaimer, the term of this patent is extended or adjusted under 35 U.S.C. 154(b) by 0 days.

(21) Appl. No.: 09/883,860

(22) Filed: Jun. 18, 2001

(51) Int. Cl.[7] ..... A47G 1/06
(52) U.S. Cl. ..... 40/798; 40/737
(58) Field of Search ..... 40/798, 737

(56) References Cited

U.S. PATENT DOCUMENTS

| | | | | | |
|---|---|---|---|---|---|
| 319,668 | A | * | 6/1885 | Baxter | 40/798 |
| 1,916,536 | A | * | 7/1933 | Slavin | 40/737 |
| 4,967,499 | A | * | 11/1990 | Rosenberg | 40/798 |
| 5,335,433 | A | * | 8/1994 | Borden | 40/737 |
| 6,209,248 | B1 | * | 4/2001 | Reinhard | 40/737 |
| 6,262,807 | B1 | * | 7/2001 | Pleotis | 40/209 |

* cited by examiner

*Primary Examiner*—Cassandra H. Davis
(74) *Attorney, Agent, or Firm*—Kriegsman & Kriegsman

(57) ABSTRACT

A picture frame for supporting and displaying a photograph or other similar item includes a frame body having a plurality of individual frame members which are affixed together. The frame body is constructed of metal and is shaped to define a center opening in which the photograph is positioned. A transparent glass plate is mounted onto the frame body over the center opening to protect the photograph without impeding visibility. For decorative purposes, text is shaped from a soft metal and is soldered onto the frame body around the center opening. In addition, a plurality of colored glass panels are mounted onto the frame body around the center opening. Furthermore, a plurality of flowers are disposed between a pair of spaced apart glass panels which, in turn, are mounted onto the frame body around the center opening.

9 Claims, 3 Drawing Sheets

PICTURE FRAME

BACKGROUND OF THE INVENTION

The present invention relates generally to frames and more particularly to frames which are adapted to retain a photograph.

Frames which are adapted to retain a photograph, also commonly referred to simply as picture frames, are well known in the art and are commonly used to support and display a photograph or other similar item.

Picture frames typically comprise a frame body, or border, which serves as a support for the picture frame. In addition, picture frames typically comprise a transparent glass plate which protects the photograph without impeding visibility of the photograph. Furthermore, picture frames typically comprise a backing for retaining the photograph within the picture frame. A stand for balancing the picture frame on a support surface is often pivotally mounted onto the backing about a hinge.

Picture frames are commonly used to retain a photograph in the following manner. Specifically, the front surface of the transparent glass plate is typically mounted onto the frame body in such a manner so that the glass plate covers a central opening defined by the frame body. The front surface of the photograph to be displayed is then disposed against the bottom surface of the transparent glass plate. As such, the photograph is positioned within the central opening in the frame body and is clearly visible through the transparent glass plate. With the glass plate and photograph mounted onto the frame body, the backing is disposed against the rear surface of the photograph and is retained in place by the frame body. Specifically, the frame body is typically provided with one or more devices, such as clips or brackets, for retaining the backing securely against the rear surface of the photograph. With the backing disposed against the rear surface of the photograph, the stand can be pivotally adjusted about the hinge so as to enable the picture frame to be balanced upon a support surface, such as a table, bookcase or mantle.

It should be noted that conventional picture frames are commonly presented in a broad variety of different styles in order to conform to the desired taste of the consumer, which is highly desirable.

As an example, the frame body of conventional picture frames is often presented in a wide variety of different colors. As a result, the consumer is able to purchase a picture frame which blends in with the decor of its immediate surroundings, which is highly desirable.

As another example, the frame body of conventional picture frames is often manufactured out of a variety of different materials. For instance, the frame body of conventional picture frames is commonly manufactured of wood, metal, glass or plastic to better accommodate the particular needs of the consumer, which is highly desirable.

SUMMARY OF THE INVENTION

It is an object of the present invention to provide a new and improved picture frame for supporting and displaying an item such as a photograph.

It is another object of the present invention to provide a picture frame as described above which is aesthetically pleasing.

It is yet another object of the present invention to provide a picture frame as described above which has a limited number of parts, which is easy to use and which is inexpensive to manufacture.

Accordingly, as one feature of the present invention, there is provided a picture frame for supporting and displaying an item, such as a photograph, the picture frame comprising a frame body adapted to support and display the item, and text mounted onto the frame body.

As another feature of the present invention, there is provided a picture frame for supporting and displaying an item, such as a photograph, said picture frame comprising a frame body adapted to support and display the item, text mounted onto said frame body, one or more colored glass panels mounted onto said frame body, a first glass panel mounted onto said frame body, a second glass panel mounted onto said frame body, and one or more flowers disposed between said first glass panel and said second glass panel.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
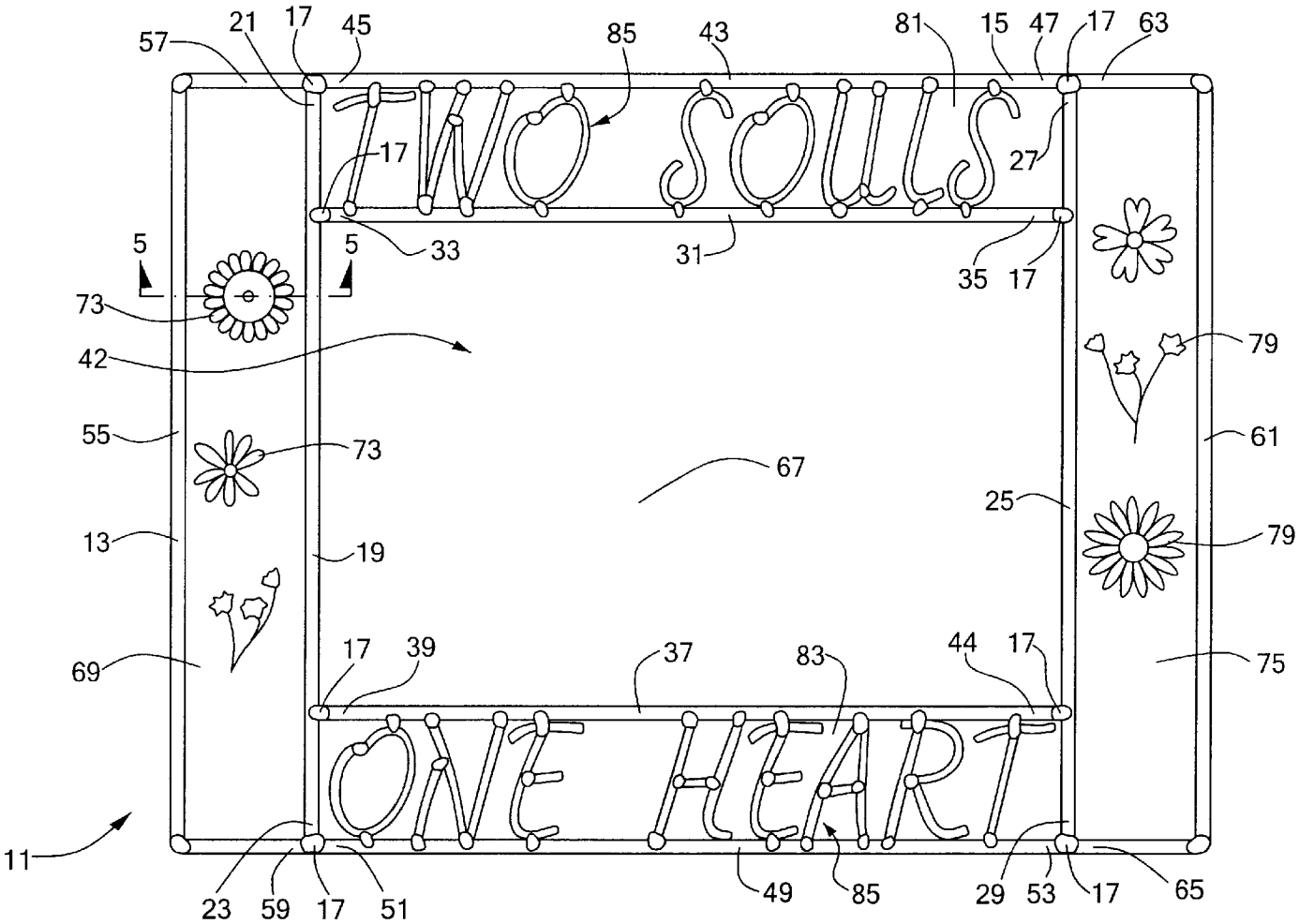
FIG. 1 is a front plan view of a picture frame constructed according to the teachings of the present invention.

Referring now to FIGS. 1–5, there is shown a picture frame constructed according to the teachings of the present invention, the picture frame being identified generally by reference numeral 11. It should be noted that picture frame 11 is adapted to hold and display a photograph or other similar item.

Picture frame 11 comprises a frame body 13 which is serves as a structural support for picture frame 11. Frame body 13 is constructed preferably of lead. However, it is to be understood that the frame body 13 is not limited to being constructed of lead. Rather, frame body 13 could be constructed of alternative types of materials, such as different forms of metals, without departing from the spirit of the present invention.

Frame body 13 comprises a plurality of individual frame members 15 which are affixed together. Preferably, frame members 15 are affixed together using solder 17. However, it is to be understood that interconnected frame members 15 are not limited to being affixed together using solder 17. Rather, interconnected frame members 15 could be affixed together using an alternative material, such as any conventional adhesive, without departing from the spirit of the present invention.

It should be noted that frame body 13 is not limited to the particular number and arrangement of interconnected frame members 15 shown in FIG. 1. Rather, it is to be understood that frame body 13 could comprise an alternative number and configuration of frame members 15 without departing from the spirit of the present invention.

Frame body 13 comprises a first inner vertical frame member 19 having a first end 21 and a second end 23. Similarly, frame body 13 comprises a second inner vertical frame member 25 having a first end 27 and a second end 29.

Frame body 13 also comprises a first inner horizontal frame member 31 having a first end 33 affixed to first inner vertical frame member 19 by solder 17 and a second end 35 affixed to second inner vertical frame member 25 by solder 17. Similarly, frame body 13 comprises a second inner horizontal frame member 37 having a first end 39 affixed to first inner vertical frame member 19 by solder 17 and a second end 41 affixed to second inner vertical frame member 25 by solder 17.

It should be noted that first inner vertical frame member 19, second inner vertical frame member 25, first inner horizontal frame member 31, and second inner horizontal frame member 37 together define a rectangular center opening 42. As can be appreciated, the photograph supported by picture frame 11 is positioned within rectangular center opening 42 for viewing, as will be described further in detail below.

Frame body 13 further comprises a first outer horizontal frame member 43 having a first end 45 affixed to first end 21 of first inner vertical frame member 19 by solder 17 and a second end 47 affixed to first end 27 of second vertical frame member 25 by solder 17. Similarly, frame body 13 comprises a second outer horizontal frame member 49 having a first end 51 affixed to second end 23 of first inner vertical frame member 19 by solder 17 and a second end 53 affixed to second end 29 of second inner vertical frame member 25 by solder 17.

Frame body 13 additionally comprises a first three-sided outer frame member 55 having a first end 57 affixed to first end 21 of first inner vertical frame member 19 by solder 17 and a second end 59 affixed to second end 23 of first inner vertical frame member 19 by solder 17. Similarly, frame body 13 comprises a second three-sided outer frame member 61 having a first end 63 affixed to first end 27 of second vertical frame member 25 by solder 17 and a second end 65 affixed to second end 29 of second vertical frame member 25 by solder 17.

A rectangular transparent glass plate 67 is mounted onto frame body 13. Specifically, a portion of each of first and second inner vertical frame members 19 and 25 is shaped to include an elongated slot which is sized and shaped to receive the left and right side, respectively, vertical edges of glass plate 67. Furthermore, each of first and second inner horizontal frame members 31 and 37 is shaped to include an elongated slot along its length which is sized and shaped to receive the top and bottom, respectively, horizontal edges of glass plate 67. In this manner, glass plate 67 is securely mounted onto frame body 13 so as to enclose center opening 42. Accordingly, with a photograph mounted onto picture frame 11, glass plate 67 protects the photograph without impeding visibility.

A rectangular transparent, or clear, glass plate 69 and a rectangular opaque, or white contoured, glass plate 71 are supported by frame body 13. Specifically, first inner vertical frame member 19 is shaped to include an elongated slot which is sized and shaped to receive the right side vertical edge of transparent glass plate 69 and white glass plate 71. Similarly, first three-sided outer frame member 55 is shaped to include an elongated slot along its length which is sized and shaped to receive the left side vertical edge, top horizontal edge and bottom horizontal edge of transparent glass plate 69 and white glass plate 71.

Figure 5:
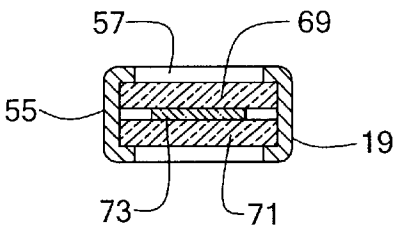
FIG. 5 is a section view of the picture frame shown in FIG. 1, taken along lines 5—5.
Figure 4:
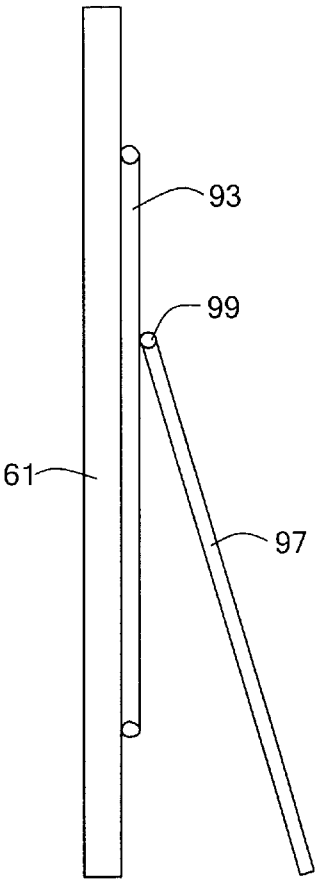
FIG. 4 is a right side view of the picture frame shown in FIG. 1.

Referring now to FIG. 5, transparent glass plate 69 lies directly above, and in parallel relation with, white glass plate 71. Furthermore, one or more pressed, or dried, flowers 73 are disposed between transparent glass plate 69 and white glass plate 71. Accordingly, with flowers 73 disposed between glass plates 69 and 71, flowers 73 are disposed around center opening 42 and are readily visible. As such, flowers 73 border around the left edge of the photograph retained by picture frame 11 for decorative purposes.

In a similar manner, a rectangular transparent, or clear, glass plate 75 and a rectangular opaque, or white, glass plate 77 are supported by frame body 13. Specifically, second inner vertical frame member 25 is shaped to include an elongated slot which is sized and shaped to receive the left side vertical edge of transparent glass plate 75 and white glass plate 77. Similarly, second three-sided outer frame member 61 is shaped to include an elongated slot along its length which is sized and shaped to receive the right side vertical edge, top horizontal edge and bottom horizontal edge of transparent glass plate 75 and white glass plate 77.

Transparent glass plate 75 lies directly above, and in parallel relation with, white glass plate 77. Furthermore, one or more pressed, or dried, flowers 79 are disposed between transparent glass plate 75 and white glass plate 77. Accordingly, with flowers 79 disposed between glass plates 75 and 77, flowers 79 are disposed around center opening 42 and are readily visible. As such, flowers 79 border around the right edge of the photograph retained by picture frame 11 for decorative purposes.

It should be noted that picture frame 11 is not limited to the particular arrangement of flowers 73 and 79. Rather, it is to be understood that the number, configuration and location of flowers 73 and 79 could be modified without departing from the spirit of the present invention.

A first rectangular colored, or stained, glass plate 81 is supported by frame body 13. Specifically, first inner horizontal frame member 31 is shaped to include an elongated slot which is sized and shaped to receive the bottom horizontal edge of stained glass plate 81. Also, first outer horizontal frame member 43 is shaped to include an elongated slot which is sized and shaped to receive the top horizontal edge of stained glass plate 81. In addition, a portion of first inner vertical frame member 19 is shaped to include an elongated slot which is sized and shaped to receive the left side edge of stained glass plate 81. Furthermore, a portion of second inner vertical frame member 25 is shaped to include an elongated slot which is sized and shaped to receive the right side edge of stained glass plate 81. Accordingly, stained glass plate 81 is securely retained within first inner horizontal frame member 31, first outer horizontal frame member 43 and first and second inner vertical horizontal frame members 19 and 25. As such, stained glass plate 81 is disposed above center opening 42 and borders the top edge of the photograph retained by picture frame 11 for decorative purposes.

A second rectangular colored, or stained, glass plate 83 is supported by frame body 13. Specifically, second inner horizontal frame member 37 is shaped to include an elongated slot which is sized and shaped to receive the top horizontal edge of stained glass plate 83. Also, second outer horizontal frame member 49 is shaped to include an elongated slot which is sized and shaped to receive the bottom horizontal edge of stained glass plate 83. In addition, a portion of first inner vertical frame member 19 is shaped to include an elongated slot which is sized and shaped to receive the left side edge of stained glass plate 83. Furthermore, a portion of second inner vertical frame member 25 is shaped to include an elongated slot which is sized and shaped to receive the right side edge of stained glass plate 83. Accordingly, stained glass plate 83 is securely retained within second inner horizontal frame member 37, second outer horizontal frame member 49 and first and second inner vertical horizontal frame members 19 and 25. As such, stained glass plate 83 is disposed beneath center opening 42 and borders the bottom edge of the photograph retained by picture frame 11 for decorative purposes.

It should be noted that picture frame 11 is not limited to the particular arrangement of stained glass plates 81 and 83. Rather, it is to be understood that the color, number, configuration and location of stained glass plates 81 and 83 could be modified without departing from the spirit of the present invention. For example, it is to be understood that a plurality of different colored stained glass plates could supported by frame body 13 to create a colorful rainbow-like border around the photograph retained by picture frame 11 without departing from the spirit of the present invention.

Text 85 is mounted onto frame body 13. It should be noted that the implementation of text 85 onto picture frame 11 and the manner in which text 85 is mounted onto frame body 13 serve as two principle features of the present invention.

Text 85 is preferably constructed of a soft metal, such as lead, which is shaped by hand into the particular phrase "TWO SOULS ONE HEART," as shown in FIG. 1.

It should be noted that text 85 is not limited to being constructed of a soft metal, such as lead. Rather, it is to be understood that text 85 could be constructed out of alternative types of similar materials, such as different types of metals, without departing from the spirit of the present invention.

Text 85 is mounted onto frame body 13 using solder 17, thereby permanently securing text 85 onto frame body 13. Specifically, the words "TWO SOULS" are affixed onto first inner horizontal frame member 31 and first outer horizontal frame member 43 so as to border the top horizontal edge of center opening 42. In addition, the words "ONE HEART" are affixed onto second inner horizontal frame member 37 and second outer horizontal frame member 49 so as to border the bottom horizontal edge of center opening 42.

It should be noted that picture frame 11 is not limited to the use of solder 17 to mount text 53 onto frame body 13. Rather, it is to be understood that text 53 could be secured onto frame body 13 by alternative means, such as using any conventional form of an adhesive, without departing from the spirit of the present invention.

It should also be noted that text 53 is not limited to the phrase "TWO SOULS ONE HEART." Rather, text 53 represents any form of lettering. Specifically, text 53 represents any sentence, phrase or initialing which is well known in the art. Accordingly, it is to be understood that text 53 could be replaced with alternative form of lettering without departing from the spirit of the present invention. Furthermore, it is to be understood that text 53 could be replaced with conventional designs or symbols without departing from the spirit of the present invention.

Figure 2:
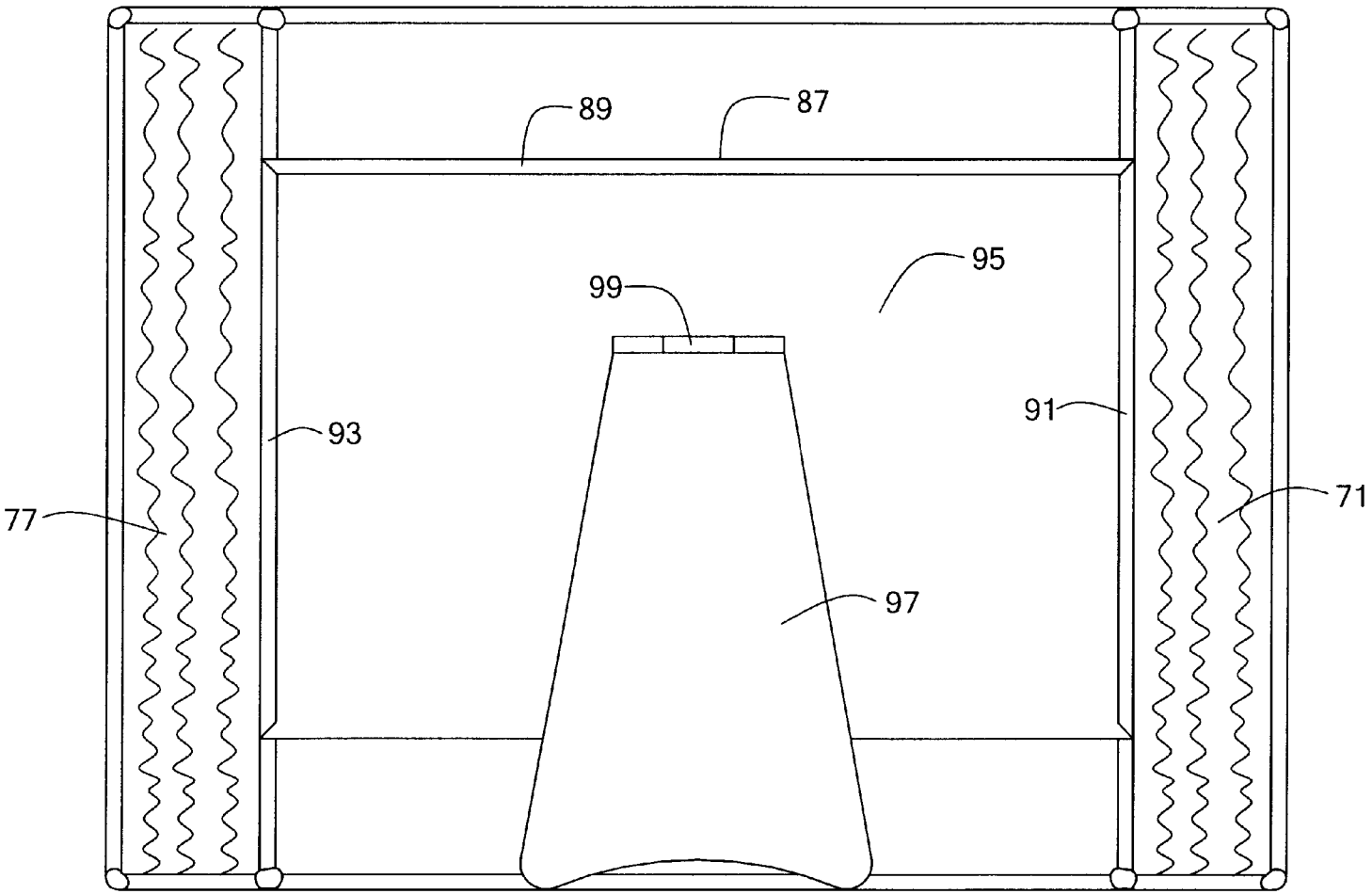
FIG. 2 is a rear plan view of the picture frame shown in FIG. 1.
Figure 3:
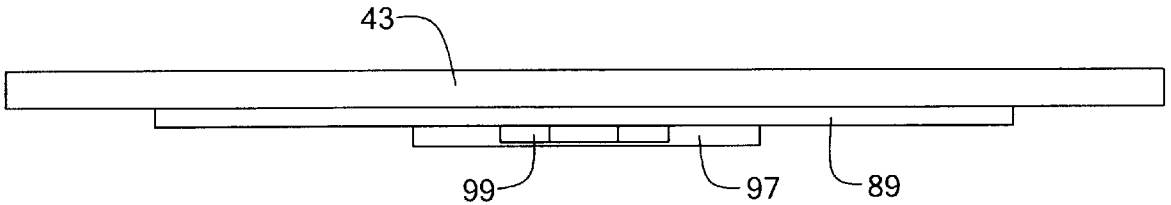
FIG. 3 is a top plan view of the picture frame shown in FIG. 1.

Referring now to FIG. 2, a flange 87 is mounted onto the back side of frame body 13, flange 87 being generally L-shaped in lateral cross-section; As will be described further in detail below, flange 87 assists in retaining the photograph against transparent glass plate 67.

Flange 87 comprises a first member 89 which is affixed to first inner horizontal frame member 31 by solder 17, a second member 91 which is affixed to first inner vertical frame member 19 by solder 17, and third member 93 which is affixed to second inner vertical frame member 25 by solder 17.

It should be noted that picture frame 11 is not limited to the use of flange 87 to retain a photograph therewithin. Rather, it is to be understood that flange 87 could be replaced with alternative forms of photograph retention devices, such as clips or fasteners, without departing from the spirit of the present invention.

A generally rectangular backing 95 is removably mounted onto frame body 13. Backing 95 is preferably constructed of a paper material, such as cardboard, and serves to retain the photograph within flange 87. Specifically, backing 95 is sized and shaped to be fittingly retained between flange 87 and glass plate 67. As such, backing 95 can be slid vertically up and under flange 87, the snug fit of backing 95 between flange 87 and glass plate 67 serving to secure the photograph in position against glass plate 67, which is highly desirable.

A stand 97 is pivotally mounted onto backing 95 about a hinge 99. As such, stand 97 may be pivotally adjusted so as to enable picture frame 11 to be disposed in a balanced position upon a mounting surface.

In use, picture frame 11 can be used in the following manner. Specifically, with backing 95 removed from frame body 13, the front surface of the desired photograph is disposed against the back surface of transparent glass plate 67. As such, the photograph is positioned within central opening 42 in frame body 13 and is clearly visible through transparent glass plate 67. Furthermore, flowers 73 and 79, stained glass plates 81 and 83, and text 85 border the photograph for decorative purposes.

With the photograph disposed against glass plate 67, backing 95 is slid under flange 87. The snug fit of backing 95 between flange 87 and glass plate 67 serves to retain the photograph against glass plate 67. Having slidably mounted backing 95 onto frame body 13, stand 97 is pivotally adjusted about hinge 99 so as to enable picture frame 11 to be properly balanced upon a support surface, such as a table, bookcase or mantle.

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A picture frame for supporting and displaying an item said picture frame comprising:

(a) a frame body adapted to support and display the item, (b) text mounted onto said frame body, (c) one or more colored glass panels mounted onto said frame body, (d) a first glass panel mounted onto said frame body, (e) a second glass panel mounted onto said frame body, and (f) one or more flowers disposed between said first glass panel and said second glass panel.

2. The picture frame of claim 1 wherein said text is constructed of metal.

3. The picture frame of claim 2 wherein said frame body is constructed of metal.

4. The picture frame of claim 3 said text is soldered onto said frame body.

5. The picture frame of claim 4 wherein said frame body is shaped to define a center opening.

6. The picture frame of claim 5 wherein said text, said one or more colored glass panels, said first glass panel, and said second glass panel are mounted onto said frame body around the center opening.

7. The picture frame of claim 6 wherein said first glass panel is disposed above said second glass panel in a spaced apart, parallel relationship.

8. The picture frame of claim 7 further comprising a third glass panel mounted onto said frame body over the center opening.

9. The picture frame of claim 8 further comprising a backing mounted onto said frame body for retaining the item onto said frame body.

* * * * *